US009009915B2

(12) United States Patent
Song et al.

(10) Patent No.: US 9,009,915 B2
(45) Date of Patent: Apr. 21, 2015

(54) UPRIGHT TYPE VACUUM CLEANER

(71) Applicants: Seunghyun Song, Seoul (KR); Hyosung Kim, Seoul (KR); Seonil Yu, Seoul (KR)

(72) Inventors: Seunghyun Song, Seoul (KR); Hyosung Kim, Seoul (KR); Seonil Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 119 days.

(21) Appl. No.: 13/775,668

(22) Filed: Feb. 25, 2013

(65) Prior Publication Data

US 2013/0232725 A1 Sep. 12, 2013

(30) Foreign Application Priority Data

Mar. 6, 2012 (KR) ..... 10-2012-0023056

(51) Int. Cl.
*A47L 5/28* (2006.01)
*A47L 9/00* (2006.01)

(52) U.S. Cl.
CPC .. *A47L 5/28* (2013.01); *A47L 9/009* (2013.01)

(58) Field of Classification Search
CPC ..... A47L 5/28; A47L 5/30; A47L 5/24; A47L 5/32; A47L 5/34; A47L 9/1427; A47L 9/242
USPC ..... 15/350, 351, 354, 327.4, 411, 410
See application file for complete search history.

(56) References Cited

U.S. PATENT DOCUMENTS

| | | | | |
|---|---|---|---|---|
| 7,950,102 | B2 * | 5/2011 | Lee et al. | 15/327.4 |
| 8,656,552 | B2 * | 2/2014 | Vines et al. | 15/410 |
| 8,677,556 | B2 * | 3/2014 | Seo | 15/351 |
| 2009/0165242 | A1 * | 7/2009 | Lee et al. | 15/411 |
| 2012/0030900 | A1 * | 2/2012 | Seo et al. | 15/354 |

FOREIGN PATENT DOCUMENTS

| | | |
|---|---|---|
| KR | 10-2009-0036002 | 4/2009 |
| KR | 10-2012-0004104 | 1/2012 |
| KR | 10-2012-0014327 | 2/2012 |

OTHER PUBLICATIONS

Korean Notice of Allowance dated Nov. 20, 2013. (English translation).

* cited by examiner

*Primary Examiner* — Dung Van Nguyen
(74) *Attorney, Agent, or Firm* — Ked & Associates LLP

(57) ABSTRACT

An upright type vacuum cleaner is disclosed. The upright type vacuum cleaner may include a main body, a suction nozzle provided at a lower end of the main body, a first leg assembly configured to support a first side of the main body, and a second leg assembly configured to support a second side of the main body. The main body may further include a coupler configured to pivotally rotatably couple the first leg assembly and the second leg assembly to each other. The first leg assembly and the second leg assembly may be rotated by different angles to support the main body when the main body is tilted leftward or rightward. The first leg assembly and the second leg assembly may be rotated by a same angle to support the main body when the main body is tilted rearward.

24 Claims, 9 Drawing Sheets

UPRIGHT TYPE VACUUM CLEANER

CROSS-REFERENCE TO RELATED APPLICATION(S)

This application claims priority to Korean Patent Application No. 10-2012-0023056, filed in Korea on Mar. 6, 2012, which is hereby incorporated by reference as if fully set forth herein.

BACKGROUND

1. Field

An upright type vacuum cleaner is disclosed herein.

2. Background

Upright type vacuum cleaners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
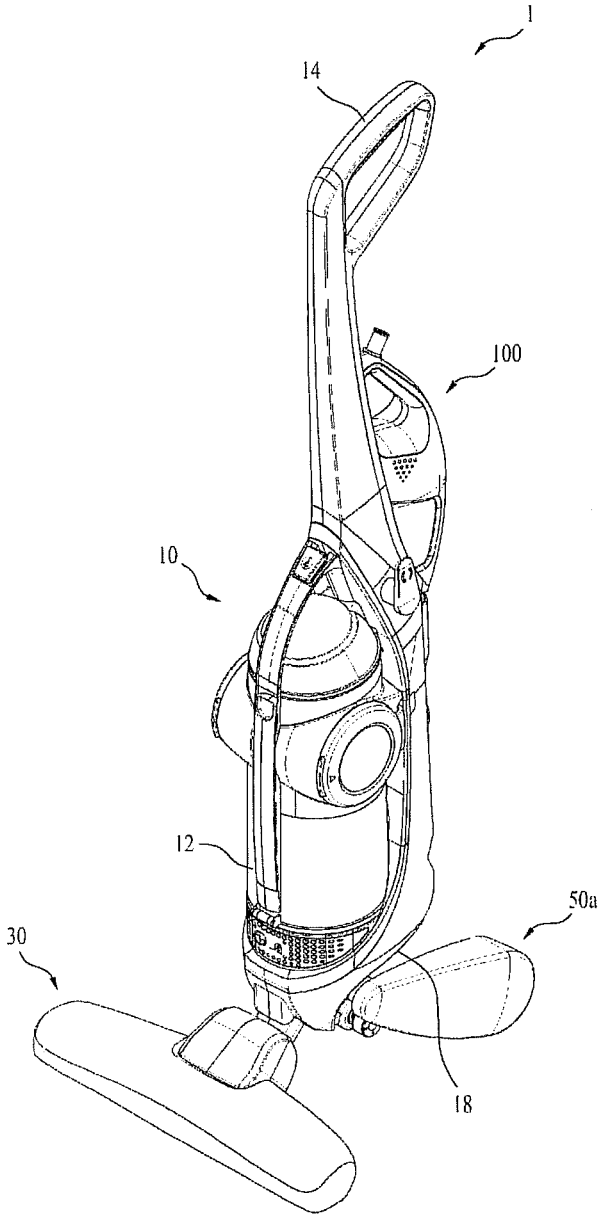
FIG. 1 is a front perspective view of an upright type vacuum cleaner according to an embodiment.

In the drawings, a thickness or size of each constituent element may be exaggerated for clarity and convenience of description. Also, terms, which are defined specifically while taking into consideration of the configurations and functions obtained in accordance with embodiments, may be replaced by other terms based on intensions of those skilled in the art, or customs. Accordingly, it should be noted that the terms used herein should be construed based on the whole content of this specification.

The scope is not limited to the disclosed embodiments, and other embodiments may be easily realized by those skilled in the art. These embodiments are also within the scope of this application.

In general, a vacuum cleaner is an apparatus that sucks in dust and dirt, for example, scattered on a surface to be cleaned, along with air, using a suction force of a suction motor mounted in a main body, and then filters the dust and dirt within the main body. The vacuum cleaner having the aforementioned function may be classified as an upright type vacuum cleaner, in which a suction nozzle serving as a suction port for dust and dirt is integrally formed with a main body, and a canister type vacuum cleaner, in which a suction nozzle is in communication with a main body through a connection pipe.

Among the aforementioned two kinds of vacuum cleaners, the upright type vacuum cleaner may include a vacuum cleaner main body, in which a suction motor that generates a suction force, for example, may be mounted, a suction nozzle, through which dust and dirt scattered on the surface to be cleaned is suctioned into the main body by the suction force generated by the suction motor, and a gripper provided on top of the main body to assist a user in moving the suction nozzle along the surface to be cleaned by gripping the gripper by hand.

When the suction motor is drive upon receiving power applied to the main body, a suction force may be generated, causing dust and dirt scattered on the surface to be cleaned to be suctioned, along with air, into the suction nozzle. The air containing dust and dirt may be introduced into the main body, and the dust and dirt separated from the air using a cyclone principle within a dust reservoir mounted in the main body. The separated dust and dirt may be collected in the dust reservoir, and the air, from which the dust and dirt have been separated, may be discharged outward from the main body through an air discharge port.

In the above-described upright type vacuum cleaner, however, the main body in which the dust reservoir and the like are mounted may apply compressive load to the suction nozzle because the main body is seated over the suction nozzle. Therefore, the upright type vacuum cleaner may exhibit deterioration in steering performance during cleaning.

To solve the above-described problem, there is a need for a new support structure for the main body to disperse the compressive load and to enhance steering performance of the upright type vacuum cleaner.

Figure 2:
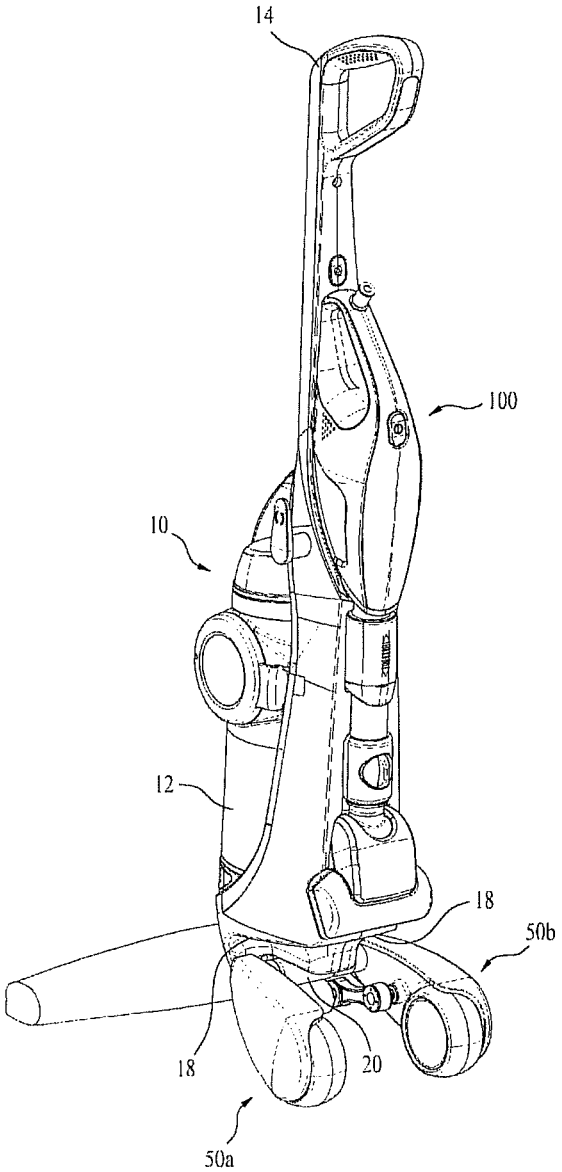
FIG. 2 is a rear perspective view of the upright type vacuum of FIG. 1.

FIG. 1 is a front perspective view of an upright type vacuum cleaner according to an embodiment, and FIG. 2 is a rear perspective view of the upright type vacuum cleaner of FIG. 1. A description with reference to FIGS. 1 and 2 follows.

The upright type vacuum cleaner 1 illustrated in FIG. 1 may include a main body 10, which may be equipped with a dust reservoir 12 in which dust and dirt, for example, scattered on a surface to be cleaned, may be collected, a suction nozzle 30, which may be installed to or at a lower end of the main body 10, that suctions in the dust and dirt scattered on the surface to be cleaned as well as air, and a gripper 14, which may be installed to or at an upper end of the main body 10, such that a user may grip the gripper 14 to move the main body 10 during cleaning.

The main body 10 may be placed on top of or above the suction nozzle 30 and may be pivotally rotatably coupled to the suction nozzle 30. As such, the main body 10 may have a variable orientation angle relative to the surface to be cleaned, which may allow the user to perform cleaning in a state in which the main body 10 is pivotally rotated toward the surface to be cleaned.

The main body 10 may be tiltable leftward or rightward with respect to the suction nozzle 30. Also, the main body 10 may be tiltable rearward with respect to the suction nozzle 30, when the gripper 14 in tilted rearward. Moreover, the leftward or rightward tilting and the rearward tilting of the main body 10 may occur simultaneously.

The dust reservoir 12 may be detachably coupled to a front surface of the main body 10. The dust reservoir 12 may be equipped with a dust separating member (not shown) that filters the dust and dirt contained in the air suctioned into the main body 10 using a cyclone principle.

More specifically, the air introduced into the main body 10 through the suction nozzle 30 may be directed into the dust reservoir 12. The dust and dirt contained in the air introduced into the dust reservoir 12 may be filtered by the dust separating member and may be collected within the dust reservoir 12. The resulting clean air, from which the dust and dirt have been removed, may be discharged outward from the main body 10. As the dust reservoir 12 is detachably coupled to the main body 10, the user may easily detach the dust reservoir 12 from the main body 10 to dispose of the dust and dirt collected in the dust reservoir 12.

Although the dust reservoir 12 illustrated in FIG. 1 has a cylindrical shape, embodiments are not so limited. That is, the dust reservoir 12 may have another shape, such as a square column shape or a polygonal column shape.

The suction nozzle 30 may be installed to or at the lower end of the main body 10, so as to be moved on the surface to be cleaned, thereby serving to suction the dust and dirt scattered on the surface to be cleaned as well as air. The suction nozzle 30 may have a slit shaped suction port (not shown), which may be perforated in a bottom thereof to extend in a longitudinal direction of the suction nozzle 30. As the suction force generated by a suction motor (not shown) mounted in the main body 10 is transmitted to the suction port, the dust and dirt scattered on the surface to be cleaned may be suctioned into the main body 10.

A hand cleaner 100 may be detachably coupled to a rear surface of the main body 10. The user may detach the hand cleaner 100 from the main body 10 to use the hand cleaner 100 when cleaning a particular area, such as stairs, for example. The hand cleaner 100 may be smaller than the main body 10, and therefore, may be used to perform cleaning in a space in which the user has difficulty moving the main body 10. Alternatively, the hand cleaner 100 may be omitted.

The upright type vacuum cleaner may include a first leg assembly 50*a* that supports a first side of the main body 10 and a second leg assembly 50*b* that supports a second side of the main body 10. The first leg assembly 50*a* and the second leg assembly 50*b* may be arranged behind the suction nozzle 30. The entire main body 10 may be supported by three locations, that is, by the suction nozzle 30, the first leg assembly 50*a*, and the second leg assembly 50*b*. This allows a weight of the main body 10 to be distributed to three locations, and thus, the main body 10 more stably supported. More specifically, the suction nozzle 30 may be located at a front side of the main body 10, the first leg assembly 50*a* may be located at a rear left side of the main body 10, and the second leg assembly 50*b* may be located at a rear right side of the main body 10, whereby the suction nozzle 30, the first leg assembly 50*a*, and the second leg assembly 50*b* may act together to support the distributed weight of the main body 10.

The first leg assembly 50*a* and the second leg assembly 50*b* may be spaced apart from each other with the main body 10 interposed therebetween and may be symmetrical to each other. Due to an empty space present between the spaced apart first leg assembly 50*a* and second leg assembly 50*b*, even if an obstacle is present between the first leg assembly 50*a* and the second leg assembly 50*b*, the obstacle may not hinder movement of the first leg assembly 50*a* and the second leg assembly 50*b*. In particular, in the case in which the surface to be cleaned has various curvatures or is a slope having different left and right heights, the first leg assembly 50*a* and the second leg assembly 50*b* may have different orientations suitable to support the main body 10, which may ensure that the user may perform cleaning while stably moving the main body 10.

The main body 10 may include a coupler 20 that pivotally rotatably couples the first leg assembly 50*a* and the second leg assembly 50*b* to each other. The coupler 20 may be placed at a bottom of the main body 10. More particularly, the first leg assembly 50*a* and the second leg assembly 50*b* may be rotated by different angles about the coupler 20, or may be rotated in different directions. For example, the first leg assembly 50*a* may be rotated clockwise about the coupler 20, whereas the second leg assembly 50*b* may be rotated counterclockwise about the coupler 20. Of course, rotational directions of the first leg assembly 50*a* and the second leg assembly 50*b* may be opposite to the above-described example.

The main body 10 may be provided at both lateral sides thereof with indented regions 18, in which the first leg assembly 50*a* and the second leg assembly 50*b* may be received and installed, respectively. The indented regions 18 may have a predetermined depth from an outermost surface of the main body 10 to ensure that the first leg assembly 50*a* and the second leg assembly 50*b* do not protrude laterally from the main body 10.

Inserting the first leg assembly 50*a* and the second leg assembly 50*b* into the indented regions 18 of the main body 10 may prevent a width of the entire upright type vacuum cleaner from increasing due to the first and second leg assemblies 50*a* and 50*b*. Thus, the resulting vacuum cleaner may achieve not only an aesthetically pleasing and slim exterior appearance, but also enhanced steering performance when the user moves the upright type vacuum cleaner.

The indented regions 18 may provide spaces in which the first leg assembly 50*a* and the second leg assembly 50*b* may be rotatable and movable via tilting. In other words, a rotatable, that is, tiltable, range of the first leg assembly 50*a* and the second leg assembly 50*b* may be limited within a shape range of the indented regions 18. If the first leg assembly 50*a* or the second leg assembly 50*b* is sufficiently rotated, one side of the first leg assembly 50*a* or the second leg assembly 50*b* may come into contact with a surface of the indented region 18, which may prevent excessive rotation of the first leg assembly 50*a* or the second leg assembly 50*b*. The coupler 20 may be located between the two indented regions 18, such that the first leg assembly 50*a* and the second leg assembly 50*b* may be fitted, respectively, into the indented regions 18.

Figure 3:
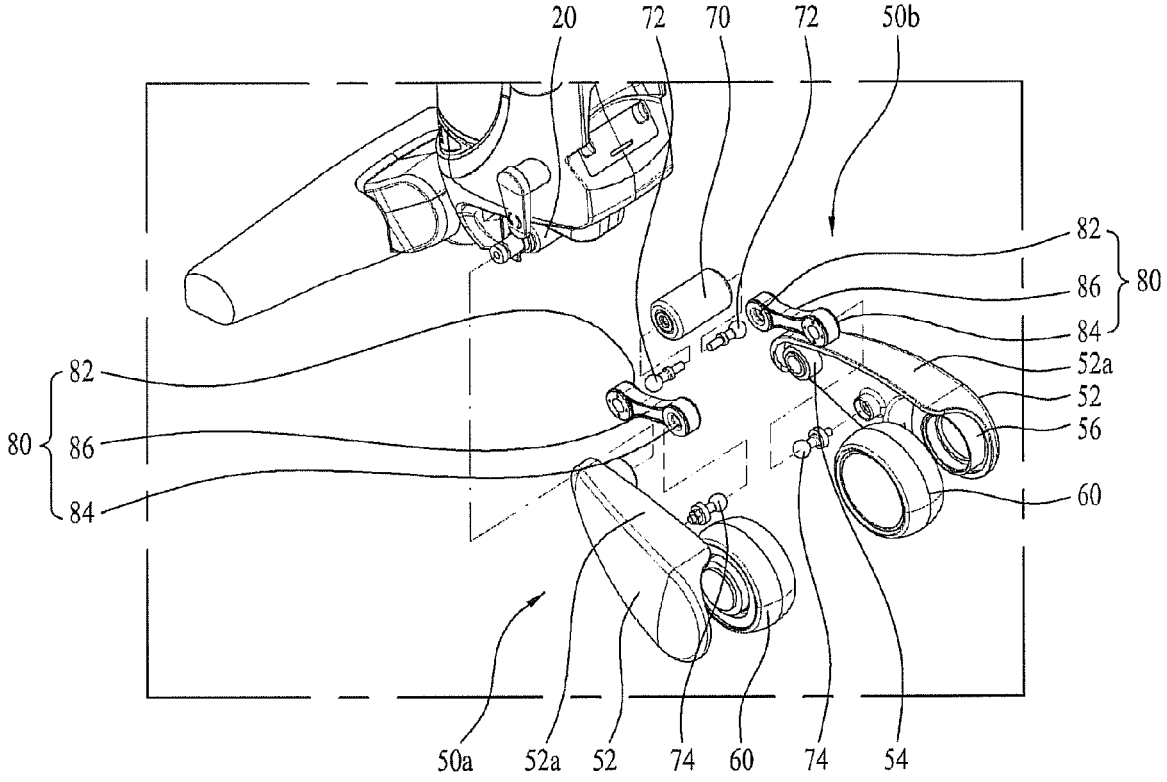
FIG. 3 is an exploded perspective view of parts of the upright type vacuum cleaner of FIG. 1.

FIG. 3 is an exploded perspective view of parts of the upright type vacuum cleaner of FIG. 1. A description with reference to FIG. 3 follows hereinbelow.

The first leg assembly 50*a* and the second leg assembly 50*b* may include the same constituent elements and may be symmetrically arranged about a center or central longitudinal axis of the main body 10. Thus, in the following description, constituent elements performing the same function of the first leg assembly 50*a* and the second leg assembly 50*b* are designated by the same names and the same reference numerals, and repetitive description has been omitted.

First, the first leg assembly 50*a* will be described. The first leg assembly 50*a* may include a housing 52 that defines an external appearance of the first leg assembly 50*a*, a first coupling piece 54 that pivotally rotatably couples the housing 52 to the coupler 20, and a second coupling piece 56, to which a rotating member 60 may be coupled. The rotating member 60 may be configured to come into contact with the surface to be cleaned.

The housing 52 may enclose constituent elements of the first leg assembly 50*a* to prevent the constituent elements from being exposed to the outside. In particular, when the first leg assembly 50*a* is viewed from a lateral side, only the exterior appearance of the housing 52 may be exposed, which may prevent the user from easily accessing the constituent elements inside the housing 52, thereby preventing damage to the constituent elements.

The housing 52 may include an upper surface 52*a* that defines an exterior appearance of an upper portion thereof. The upper surface 52*a* may be horizontally bent from a vertical surface of the housing 52 by a predetermined angle. The upper surface 52*a* may completely seal the upper portion of the first leg assembly 50*a*, thereby preventing the inner constituent elements from being exposed to the user.

If the first leg assembly 50*a* is excessively rotated, the upper surface 52*a* may come into contact with the surface of the indented region 18. Once the upper surface 52*a* comes into contact with the surface of the indented region 18, the upper surface 52*a*, for example, the housing 52 may no longer be rotatable. As such, it is possible to limit a rotational degree, for example, a tilting degree of the first leg assembly 50*a* due to the upper surface 52*a*.

The first coupling piece 54 may be received in a first end of the housing 52, and the second coupling piece 56 may be received in a second end of the housing 52. As such, the user may have difficulty accessing the first coupling piece 54 and the second coupling piece 56, because the first coupling piece 54 and the second coupling piece 56 are received within the housing 52, which may ensure that the first coupling piece 54 and the second coupling piece 56 stably maintain a coupling relationships thereto.

More particularly, rotation centers of the first coupling piece 54 and the second coupling piece 56 may be spaced apart from each other. As the first coupling piece 54 is rotatably coupled to the coupler 20 and the rotating member 60 is rotatably coupled to the second coupling piece 56, the first coupling piece 54 and the second coupling piece 56 may have different rotational axes. As such, the rotating member 60 may be rotatable about the second coupling piece 56, regardless of rotation of the housing 52 about the first coupling piece 54.

The rotating member 60 may include a circular wheel, for example, and may be rotatably coupled to the second coupling piece 56. A face of the rotating member 60 in contact with the surface to be cleaned may be symmetrically inclined by a predetermined angle about a center axis thereof. The rotating member 60 may not always come into vertical contact with the surface to be cleaned, but may often come into contact with the surface to be cleaned in a state of being tilted leftward or rightward by a predetermined angle. Even in the latter case, accordingly, the rotating member 60 may realize stable contact with the surface to be cleaned, due to the above-described symmetrical tilting configuration thereof.

Connection members discussed hereinbelow may be provided to connect the first leg assembly 50*a* and the second leg assembly 50*b* to each other. The connection members may not be fixed to the main body 10. Although one side of each of the first leg assembly 50*a* and the second leg assembly 50*b* may be independently connected to the main body 10, the first leg assembly 50*a* and the second leg assembly 50*b* may act to limit rotation of the other side due to the connection members. Assuming that no connection member is provided, the first leg assembly 50*a* and the second leg assembly 50*b* may not limit rotation of the other side, and thus, may be excessively rotated in different ways or directions. This excessive rotation may cause damage to the first leg assembly 50*a* and the second leg assembly 50*b*.

More particularly, the connection members may include a connector 70 that connects the first leg assembly 50*a* and the second leg assembly 50*b* to each other. The connector 70 may not be fixed to the main body 10. Thus, the connector 70 may not be restricted by the main body 10, and a position of the connector 70 may be changeable depending on an operation of the first leg assembly 50*a* and the second leg assembly 50*b*.

The connector 70 may serve to limit movement ranges of the first leg assembly 50*a* and the second leg assembly 50*b* relative to each other. For example, the connector 70 may limit a movement range of the second leg assembly 50*b* depending on whether the first leg assembly 50*a* is tilted in any one direction. That is, the movement range of the second leg assembly 50*b* may be changeable depending on a movement range of the first leg assembly 50*a*.

The connection members may further include a pair of links 80 pivotally rotatably coupled to both ends of the connector 70. The first leg assembly 50*a* may be connected to the second leg assembly 50*b* via the links 80 and the connector 70 interposed therebetween while being coupled at one end thereof to the coupler 20.

Each link 80 may extend a predetermined length, and may serve to locate the connector 70 at a position adjacent to the coupler 20, that is, at a position adjacent to the main body 10. As the connector 70, that is, a structure for enabling relative movements of the first leg assembly 50*a* and the second leg assembly 50*b* may be located adjacent to the main body 10, spaces spaced apart from each other may be located behind the first leg assembly 50*a* and the second leg assembly 50*b*. In this way, even if an obstacle is present between the first leg assembly 50*a* and the second leg assembly 50*b*, easy steering of the upright type vacuum cleaner may be performed without interference with the obstacle.

More particularly, the connector 70 may include first spherical protruding pieces 72, and the link 80 may include a first receiving recess 82, in which a corresponding one of the first protruding pieces 72 may be received. The first protruding piece 72 having a spherical shape may be freely rotatable in the first receiving recess 82, which may ensure upward or downward tilting, as well as leftward or rightward tilting of the connector 70.

Alternatively, the first protruding piece 72 may be formed at or on the link 80, and the first receiving recess 82 may be formed at or on the connector 70. In this case, the first protruding piece 72 may be integrally fixed to the connector 70, and the first receiving recess 82 may be pivotally rotatable relative to the first protruding piece 72.

The housing 52 may include a second spherical protruding piece 74, and the link 80 may be provided with a second receiving recess 84, in which the second protruding piece 74 may be received. As the second protruding piece 74 is engaged with the second receiving recess 84, the housing 52 and the link 80 may be coupled to each other.

The link 80 may further include a connecting node 86 that connects the first receiving recess 82 and the second receiving recess 84 to each other. The connecting node 86 may have a thickness less than a thickness of end portions of the link 80 where the first receiving recess 82 and the second receiving recess 84 are indented, as the thickness of the connecting node 86 is a factor determining a weight of the connecting node 86, and thus, the link 80. However, the end portions of the link 80 where the first receiving recess 82 and the second receiving recess 84 are indented have a predetermined thickness required to achieve sufficient strength to compensate for deterioration in strength due to empty spaces defined by the first receiving recess 82 and the second receiving recess 84. The connecting node 86 has no such recess, and therefore, has no deterioration in strength. As such, the entire link 80 may be configured, such that the connecting node 86 has a thickness and width less than a thickness and width of the end portions where the first receiving recess 82 and the second receiving recess 84 are indented, thereby achieving a reduction in weight of the link 80. That is, the user may perform cleaning while moving the vacuum cleaner with less force due to the reduced weight of the first leg assembly 50*a*.

The first receiving recess 82 and the second receiving recess 84 may be spaced apart from each other with the connecting node 86 having a predetermined length interposed therebetween. As such, the connector 70 may be located at one end of the housing 52.

The first receiving recess 82 and the second receiving recess 84 may be arranged opposite to each other with respect to the connecting node 86. In other words, the first receiving recess 82 and the second receiving recess 84 may be arranged at left and right sides of the connecting node 86. Similarly, the first receiving recess 82 and the second receiving recess 84 may be indented in opposite directions with respect to the connecting node 86. This arrangement of the first receiving recess 82 and the second receiving recess 84 opposite to each other may ensure that the weight of the link 80 is not biased to any one side, resulting in balance of the link 80.

The above description of the first leg assembly 50*a* may be equally applied to the second leg assembly 50*b*. Further, the arrangement and shapes of the respective constituent elements of the second leg assembly 50*b* may be symmetrical to those of the first leg assembly 50*a*. Thus, a detailed description of the second leg assembly 50*b* has been omitted.

Figure 4:
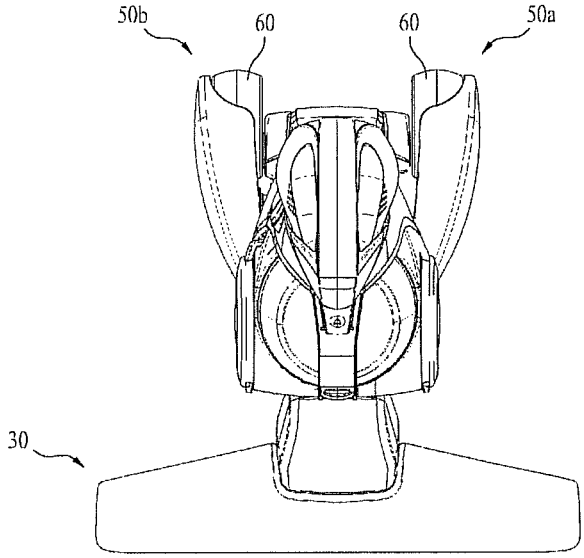
FIG. 4 is a top view of the upright type vacuum cleaner of FIG. 1.

FIG. 4 is a top view of the upright type vacuum cleaner of FIG. 1. Hereinafter, a description with reference to FIG. 4 will follow.

When the vacuum cleaner is viewed from a top side, the upper surface 52*a* of the housing 52 may surround the inner constituent elements, such as the first coupling piece 54, the second coupling piece 56, and the link 80, for example. However, it is noted that a portion of the rotating member 60 may be exposed, as illustrated in FIG. 4. Also, the first leg assembly 50*a* and the second leg assembly 50*b* may be arranged symmetrical to each other.

Figure 5:
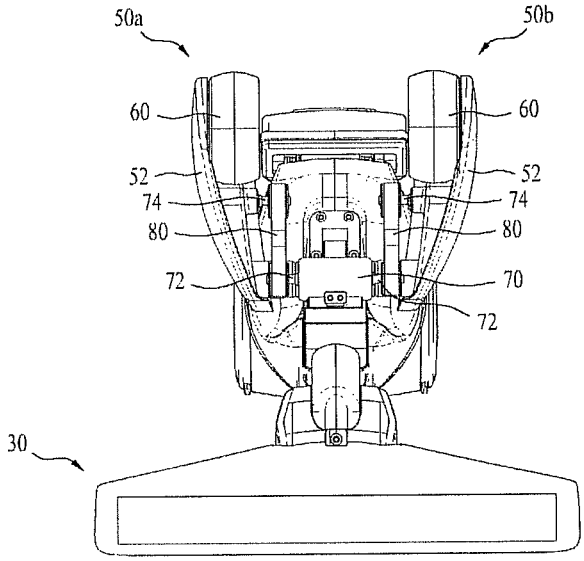
FIG. 5 is a bottom view of the upright type vacuum cleaner of FIG. 1.

FIG. 5 is a bottom view of the upright type vacuum cleaner of FIG. 1. Hereinafter, a description with reference to FIG. 5 will follow.

When the vacuum cleaner is viewed from a bottom side, it may be appreciated that the first leg assembly 50*a* and the second leg assembly 50*b* may be symmetrical to each other about or with respect to the connector 70. The first protruding piece 72 and the second protruding piece 74 may be received, respectively, in the first receiving recess 82 and the second receiving recess 84 at both ends of the link 80 so as to be arranged opposite to each other. This configuration may equally be applied to the first leg assembly 50*a* and the second leg assembly 50*b*. As the coupler 20 is located above the connector 70, the coupler 20 hidden by the connector is not illustrated in FIG. 5.

Figure 6:
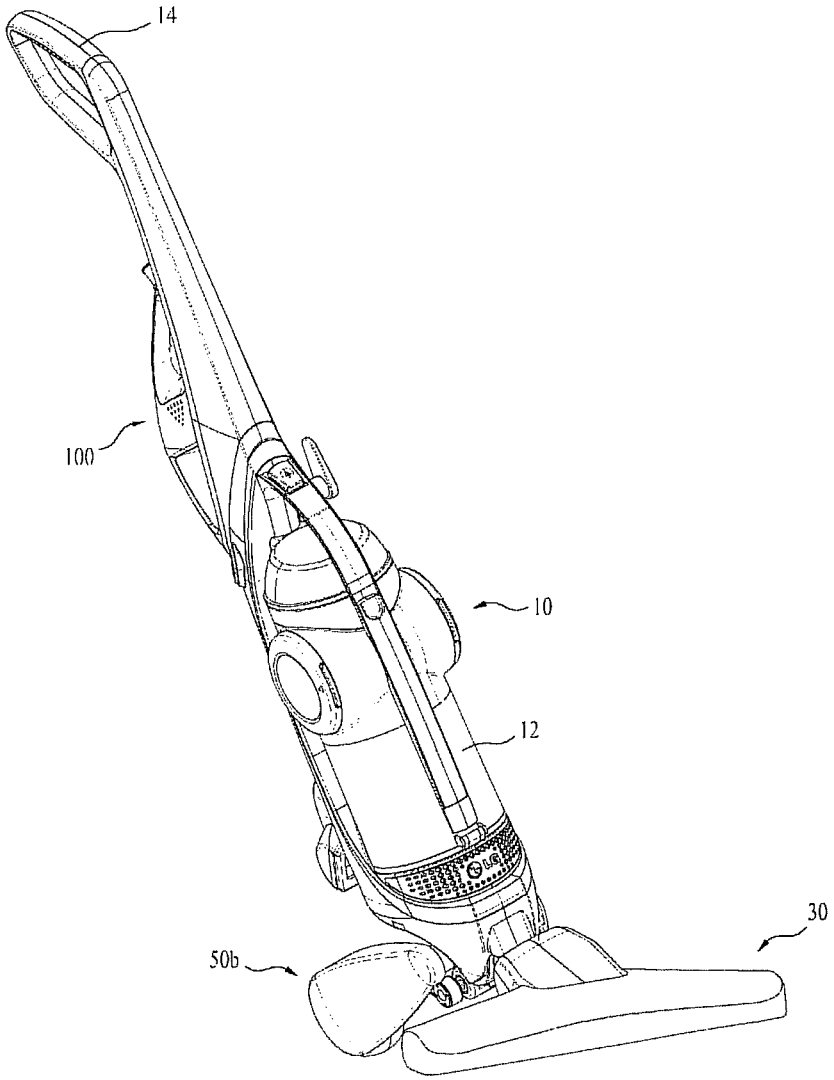
FIG. 6 is a front perspective view of the upright type vacuum cleaner of FIG. 1, in a rightward tilted state.
Figure 7:
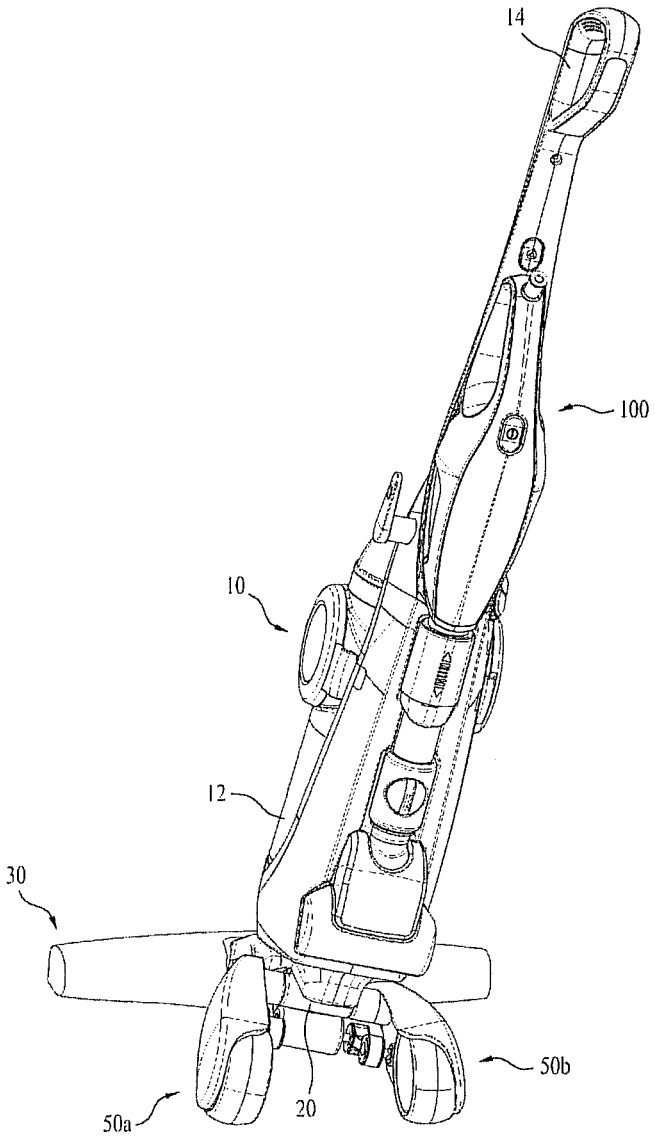
FIG. 7 is a rear perspective view of the upright type vacuum cleaner of FIG. 6, in a rightward tilted state.

FIG. 6 is a front perspective view of the upright vacuum cleaner of FIG. 1 in a rightward tilted state, and FIG. 7 is a rear perspective view of the upright type vacuum cleaner of FIG. 6, in a rightward tilted state. Hereinafter, operations of the upright type vacuum cleaner will be described with reference to FIGS. 6 and 7.

The user may first power on the main body 10 to clean a surface to be cleaned, and then bring the suction nozzle 30 into contact with the surface to be cleaned. Then, as the user moves the main body 10, the suction nozzle 30 may be moved on the surface to be cleaned.

The user may tilt the main body 10 leftward or rightward with respect to the suction nozzle 30. FIGS. 6 and 7 illustrate a state in which the user tilts the main body 10 rightward with respect to the suction nozzle 30.

As illustrated in FIG. 6, if the main body 10 is rotated clockwise about the suction nozzle 30, the main body 10 may be tilted rightward. Through clockwise rotation of the main body 10, as illustrated in FIG. 7, the first leg assembly 50*a* located at the left side of the main body 10 may be rotated clockwise, whereas the second leg assembly 50*b* located at the right side of the main body 10 may be rotated counterclockwise. In this case, the first leg assembly 50*a* and the second leg assembly 50*b* may be rotated about the coupler 20.

As illustrated in FIGS. 1 and 2, the first leg assembly 50*a* and the second leg assembly 50*b* may have the same shape and orientation before the user tilts the main body 10 rightward. However, once the user has tilted the main body 10 rightward, as illustrated in FIGS. 6 and 7, the first leg assembly 50*a* and the second leg assembly 50*b* may be individually rotated relative to the coupler 20 according to a tilt angle determined by the user, thereby supporting the main body 10 on the surface to be cleaned.

The respective links 80 of the first leg assembly 50*a* and the second leg assembly 50*b* may limit rotations of the first leg assembly 50*a* and the second leg assembly 50*b* relative to each other. In other words, the link 80 of the first leg assembly 50*a* and the link 80 of the second leg assembly 50*b* may be pivotally rotated at different angles.

More particularly, the first protruding piece 72 and the second protruding piece 74 of each of the first leg assembly 50*a* and the second leg assembly 50*b* may have spherical shapes, which may cause various orientations of the connector 70 according to pivotal rotation of the first leg assembly 50*a* and the second leg assembly 50*b*. However, the first leg assembly 50*a* and the second leg assembly 50*b* may be linked with each other via the connector 70, and the linked operation of the first leg assembly 50*a* and the second leg assembly 50*b* may have an effect on operations of the other constituent elements.

On the other hand, differently from the illustration of FIGS. 6 and 7, if the main body 10 is tilted leftward, a configuration opposite to that illustrated in FIGS. 6 and 7 may be accomplished. That is, the first leg assembly 50*a* may be rotated counterclockwise about the coupler 20 and the second leg assembly 50*b* may be rotated clockwise about the coupler 20, thereby supporting the main body 10. In this case, an arrangement of the link 80 and the connector 70 opposite to that illustrated in FIGS. 6 and 7 may be obtained. That is, a deformed configuration of the first leg assembly 50*a* may be directly applied to a deformed configuration of the second leg assembly 50*b*.

Figure 8:
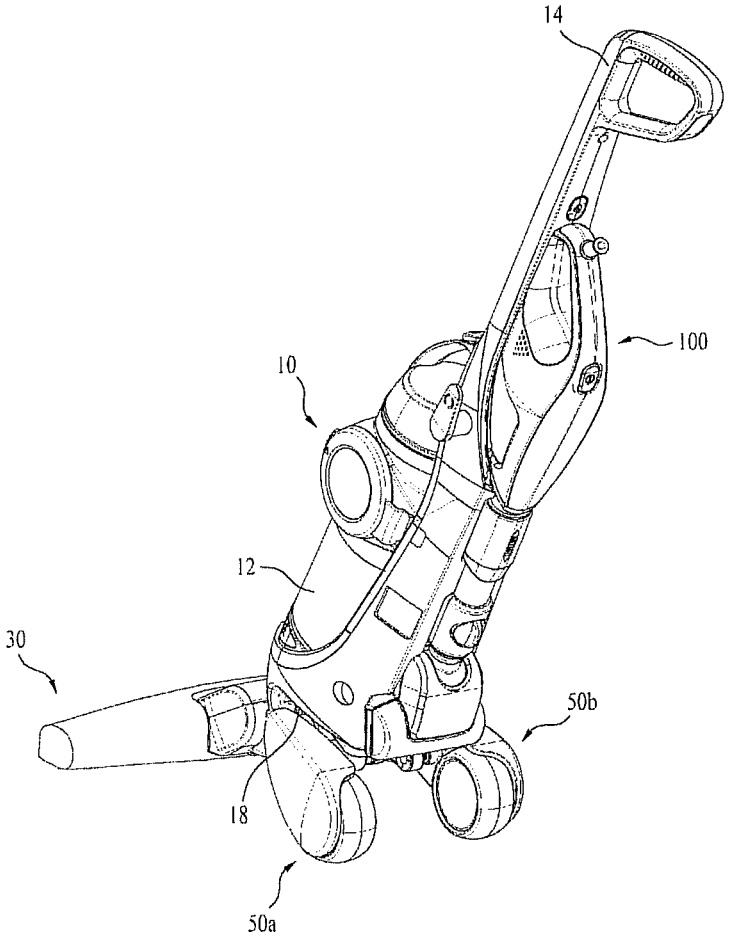
FIG. 8 is a rear perspective view of the upright type vacuum cleaner of FIG. 1, in a rearward tilted state.

FIG. 8 is a rear perspective view of the upright type vacuum cleaner of FIG. 1, in a rearward tilted state. A description with reference to FIG. 8 follows hereinbelow.

In FIG. 8, unlike FIGS. 6 and 7, the main body 10 may be tilted rearward from the suction nozzle 30, rather than being tilted leftward or rightward. More particularly, this corresponds to a case in which the user attempts to move the suction nozzle 30 and the main body 10 forward to clean the surface to be cleaned in front of the user. In this case, as the main body 10 is not tilted leftward or rightward with respect to the suction nozzle 30, the weight of the main body 10 may be uniformly distributed to the first leg assembly 50*a* and the second leg assembly 50*b*.

The first leg assembly 50*a* and the second leg assembly 50*b* may be rotated by the same angle with respect to the coupler 20, thereby supporting the main body 10. In particular, both the first leg assembly 50*a* and the second leg assembly 50*b* may be equally rotated counterclockwise with respect to the coupler 20. In this case, the link 80 of the first leg assembly 50*a* and the link 80 of the second leg assembly 50*b* may be equally moved, thereby acting to restrict movements of the first leg assembly 50*a* and the second leg assembly 50*b*.

If the user excessively tilts the main body 10 rearward, the upper surfaces 52*a* may come into contact with the surfaces of the indented regions 18, whereby additional rotation of the first leg assembly 50*a* and the second leg assembly 50*b* may be prevented. That is, the indented regions 18 provide spaces to accommodate tilt and movement of the first leg assembly 50*a* and the second leg assembly 50*b*.

Figure 9:
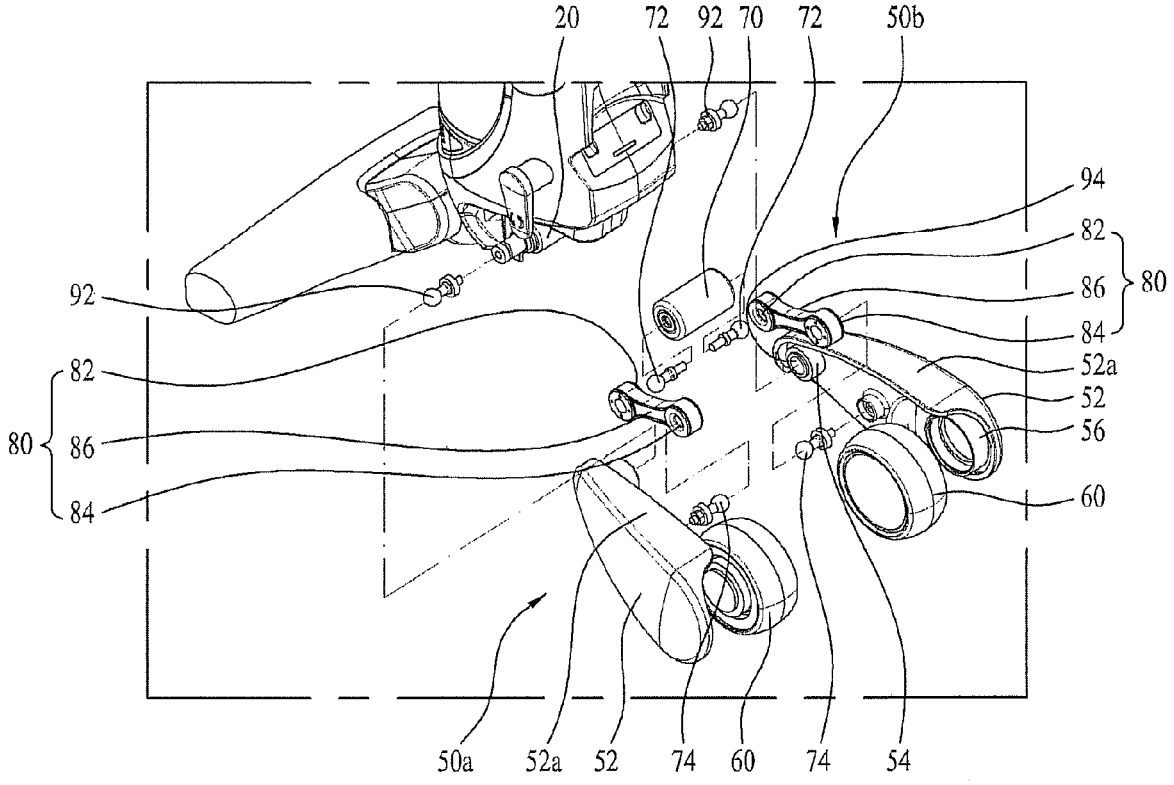
FIG. 9 is an exploded perspective view of parts of an upright type vacuum cleaner according to another embodiment.

FIG. 9 is an exploded perspective view of parts of an upright type vacuum cleaner according to another embodiment. In comparison to the above-described embodiment with reference to FIG. 3, this embodiment has a different coupling configuration between the coupler and the first and second leg assemblies. All other constituent elements may be the same. Hereinafter, for convenience of description, only the difference will be described and repeated description has been omitted.

Third spherical protruding pieces 92 may be provided at both ends of the coupler 20. The first coupling piece 54 may have a third receiving recess 94, in which the third protruding piece 92 may be received. The third protruding piece 92 may be inserted into the third receiving recess 94 and may be rotated by various angles due to the spherical shape thereof.

The third protruding piece 92 may be integrally fixed to the coupler 20, and the third receiving recess 94 may be pivotally rotatable relative to the third protruding piece 92. The coupler 20 may be fixed to the main body 10, and therefore, the third protruding piece 92 may be continuously coupled to the main body 10. As such, the third protruding piece 92 may constitute a part of the main body 10, rather than constituting a part of the first leg assembly 50*a* or the second leg assembly 50*b*, which has the effect of reducing the weight of the first leg assembly 50*a* or the second leg assembly 50*b*, and consequently, facilitating easy steering of the upright type vacuum cleaner.

Through engagement between the third protruding piece 92 and the third receiving recess 94, the first coupling piece 54 may be movable vertically or horizontally with respect to the coupler 20, having an increased degree of freedom depending on movement of the first leg assembly 50*a* or the second leg assembly 50*b*. Thus, even if the surface to be cleaned is not even, orientations of the first leg assembly 50*a* and the second leg assembly 50*b* may be changed depending on the shape of the surface to be cleaned, which may allow the main body 10 to be more stably supported.

With this embodiment, additionally, support members may be rotatably connected to the coupler 20 provided at or on the main body 10 to movably support the main body 10 behind the main body 10. When the main body 10 is tilted rearward and moved forward, both the support members may be rotated by the same angle with respect to the coupler 20. When the main body 10 is tilted leftward or rightward and moved leftward or rightward, the support members may be rotated by different angles with respect to the coupler 20. The support members may include the first leg assembly 50*a* and the second leg assembly 50*b*.

As is apparent from the above description, according to embodiments disclosed herein, easy user steering of a main body of an upright type vacuum cleaner is possible. Further, according to embodiments disclosed herein, by supporting the weight of the entire main body at three dispersed locations, more stable support of the main body is possible.

Furthermore, according to embodiments disclosed herein, two leg assemblies may be spaced apart from each other with an empty space interposed therebetween. This arrangement may ensure a more easy movement and cleaning operation of the upright type vacuum cleaner when a surface to be cleaned is sloped with different left and right heights.

Embodiments disclosed herein are directed to an upright type vacuum cleaner that substantially obviates one or more problems due to limitations and disadvantages of the related art. Further, embodiments disclosed herein provide an upright type vacuum cleaner capable of assisting a user in easily steering a main body.

Furthermore, embodiments disclosed herein provide an upright type vacuum cleaner capable of easily cleaning an uneven surface to be cleaned.

Embodiments disclosed herein provide an upright type vacuum cleaner that may include a main body, a suction nozzle provided at a lower end of the main body, a first leg assembly configured to support one side or a first side of the main body, and a second leg assembly configured to support the other side or a second side of the main body. The main body may include a coupler configured to pivotally rotatably couple the first leg assembly and the second leg assembly to each other. The first leg assembly and the second leg assembly may be rotated by different angles to support the main body when the main body is tilted leftward or rightward. The first leg assembly and the second leg assembly may be rotated by a same angle to support the main body when the main body is tilted rearward.

Embodiments disclosed herein provide an upright type vacuum cleaner that may include a main body, a suction nozzle provided in a front of the main body, and supporting members rotatably connected to both ends of a coupler provided at the main body, the supporting members being located behind the main body to movably support the main body. The support members may be rotated by a same angle with respect to the coupler when the main body is tilted rearward and moved forward, and may be rotated by different angles with respect to the coupler when the main body is tilted leftward or rightward and moved leftward or rightward.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An upright type vacuum cleaner, comprising:

a main body;

a suction nozzle in communication with the main body;

a first leg assembly configured to support a first side of the main body;

a second leg assembly configured to support a second side of the main body; and a connection member configured to connect the first leg assembly and the second leg assembly to each other, such that pivot ranges of the first leg assembly and the second leg assembly are restricted relative to each other, wherein the connection member includes a connector configured to connect the first leg assembly and the second leg assembly, and a pair of links pivotally coupled to respective ends of the connector, wherein the first leg assembly and the second leg assembly are configured to pivot by different angles to support the main body when the main body is tilted in a first or second direction, and wherein the first leg assembly and the second leg assembly are configured to pivot by a same angle to support the main body when the main body is tilted in a third direction.

2. The upright type vacuum cleaner according to claim 1, wherein the first direction is a leftward direction, the second direction is a rightward direction, and the third direction is a rearward direction.

3. The upright type vacuum cleaner according to claim 1, wherein the third direction is substantially perpendicular to the first and second directions.

4. The upright type vacuum cleaner according to claim 1, wherein the main body includes a coupler configured to couple the first leg assembly and the second leg assembly to each other.

5. The upright type vacuum cleaner according to claim 1, wherein the suction nozzle is provided at a lower end of the main body.

6. The upright type vacuum cleaner according to claim 4, wherein the first leg assembly and the second leg assembly are configured to pivot in opposite directions about the coupler to support the main body when the main body is tilted in the first direction or the second direction.

7. The upright type vacuum cleaner according to claim 1, wherein the first leg assembly and the second leg assembly are spaced apart from each other in the first or second direction.

8. The upright type vacuum cleaner according to claim 1, wherein the first leg assembly and the second leg assembly are disposed symmetrical to each other with respect to the main body.

9. The upright type vacuum cleaner according to claim 4, wherein each of the first leg assembly and the second leg assembly includes:

a housing that defines an external appearance of the respective leg assembly;

a first coupling piece configured to pivotally couple the housing to the coupler; and a second coupling piece, to which a rotating member is coupled, the rotating member being rotatable in contact with a surface to be cleaned.

10. The upright type vacuum cleaner according to claim 9, wherein the first coupling piece and the second coupling piece have rotational centers spaced apart from each other.

11. The upright type vacuum cleaner according to claim 10, wherein a face of the rotating member coming into contact with the surface to be cleaned is symmetrically inclined by a predetermined angle about a center axis thereof.

12. The upright type vacuum cleaner according to claim 9, wherein the first coupling piece and the second coupling piece are located inside of the housing.

13. The upright type vacuum cleaner according to claim 9, wherein each of the housing of the first and second leg assemblies includes an upper surface that defines an exterior appearance of an upper portion thereof.

14. The upright type vacuum cleaner according to claim 1, wherein the connector includes a pair of first protruding pieces spherical in shape, and wherein each of the pair of links includes a first receiving recess in which a corresponding one of the pair of first protruding pieces is received.

15. The upright type vacuum cleaner according to claim 14, wherein the pair of first protruding pieces are integrally formed with the connector.

16. The upright type vacuum cleaner according to claim 14, wherein each of the first leg assembly and the second leg assembly further includes a second protruding piece spherical in shape, and wherein each of the pair of links has a second receiving recess in which a corresponding one of the second protruding piece is received.

17. The upright type vacuum cleaner according to claim 16, wherein each link of the pair of links includes a connecting node configured to connect the first receiving recess and the second receiving recess to each other, and wherein the connecting node has a thickness less than a thickness of end portions of the link in which the first receiving recess and the second receiving recess are formed.

18. The upright type vacuum cleaner according to claim 16, wherein the first protruding piece and the second protruding piece are arranged on opposite sides of the link.

19. The upright type vacuum cleaner according to claim 18, wherein a pair of third protruding pieces, spherical in shape, are provided, respectively, at both ends of a coupler provided on the main body to couple the first leg assembly and the second leg assembly to each other, and wherein each of the first coupling piece of the first and second leg assemblies includes a third receiving recess in which a corresponding one of the pair of third protruding pieces is received.

20. The upright type vacuum cleaner according to claim 19, wherein the pair of third protruding pieces are integrally formed with the coupler.

21. The upright type vacuum cleaner according to claim 1, wherein the main body includes a pair of indented regions having a predetermined depth in which the first leg assembly and the second leg assembly are received and coupled thereto, respectively.

22. The upright type vacuum cleaner according to claim 21, wherein the pair of indented regions provide spaces for tilting and movement of the first leg assembly and the second leg assembly, respectively.

23. An upright type vacuum cleaner, comprising:

a main body;

a suction nozzle in communication with the main body; and a pair of supporting members pivotably connected to ends of a coupler provided on the main body, the pair of supporting members being located behind the main body to movably support the main body, wherein the pair of supporting members are pivoted by a same angle with respect to the coupler when the main body is tilted in a first direction or a second direction or the vacuum cleaner is moved in the first direction or the second direction, wherein the pair of supporting members are pivoted by different angles with respect to the coupler when the main body is tilted or moved in a third direction or a fourth direction, wherein the pair of supporting members are connected via a connector, and wherein the connector is not coupled to the main body.

24. The upright type vacuum cleaner according to claim 23, wherein the first direction is a leftward direction, the second direction is a rightward direction, the third direction is a rearward direction, and the fourth direction is a frontward direction.

* * * * *